US012426704B2

(12) United States Patent
Wu

(10) Patent No.: US 12,426,704 B2
(45) Date of Patent: Sep. 30, 2025

(54) PORTABLE FOLDING OUTDOOR TABLE

(71) Applicant: Yiwu Haoya Culture&Sports Goods Co., Ltd., Zhejiang (CN)

(72) Inventor: Ergo Wu, Hong Kong (HK)

(73) Assignee: Yiwu Haoya Culture & Sports Goods Co., Ltd., Jinhua (CN)

( * ) Notice: Subject to any disclaimer, the term of this patent is extended or adjusted under 35 U.S.C. 154(b) by 106 days.

(21) Appl. No.: 18/596,611

(22) Filed: Mar. 5, 2024

(65) Prior Publication Data

US 2025/0280950 A1 Sep. 11, 2025

(51) Int. Cl.

| | |
|---|---|
| ***A47B 3/12*** | (2006.01) |
| ***A47B 3/00*** | (2006.01) |
| ***A47B 13/00*** | (2006.01) |
| ***A47B 13/02*** | (2006.01) |

(52) U.S. Cl.

CPC ..... *A47B 3/12* (2013.01); *A47B 3/002* (2013.01); *A47B 13/003* (2013.01); *A47B 2013/026* (2013.01)

(58) Field of Classification Search

CPC .. A47B 3/12; A47B 3/002; A47B 3/06; A47B 3/083; A47B 2003/0835; A47B 2013/026; A47B 13/003

See application file for complete search history.

(56) References Cited

U.S. PATENT DOCUMENTS

| | | | | |
|---|---|---|---|---|
| 1,464,440 | A * | 8/1923 | Monroe | A47B 3/083 108/173 |
| 3,303,797 | A * | 2/1967 | Mueller | A47B 3/083 108/66 |
| 4,941,413 | A * | 7/1990 | Vanderminden | A47B 13/083 108/157.15 |
| 6,032,590 | A * | 3/2000 | Chen | A47B 3/12 403/381 |
| 9,848,695 | B1 * | 12/2017 | Gauss | A47B 3/0809 |
| 11,925,257 | B1 * | 3/2024 | Downey | A47B 3/002 |
| 2017/0135465 | A1 * | 5/2017 | Tao | A47B 13/088 |
| 2021/0153643 | A1 * | 5/2021 | Haddy | A47B 13/16 |
| 2024/0049877 | A1 * | 2/2024 | Wiedeman | F16M 11/041 |
| 2025/0143449 | A1 * | 5/2025 | Douglas | A47B 13/088 |

* cited by examiner

*Primary Examiner* — Daniel J Rohrhoff

(57) ABSTRACT

The present disclosure relates to the field of outdoor tables and discloses a portable folding outdoor table, which including a table board assembly, and a supporting leg assembly detachably connected to the table board assembly. The table board assembly includes a first table board, a second table board hinged with the first table board. A hinged locating mechanism is arranged between the first table board and the second table board. The hinged locating mechanism includes a first planar hinged board, a second planar hinged board, a first locating hinged board and a second locating hinged board. The present disclosure makes the table board assembly and the supporting leg assembly convenient to disassemble and assemble. The table board assembly can be turned and folded when the portable folding outdoor table is stored, so that the portable folding outdoor table occupies a small space and is convenient to transport and carry.

11 Claims, 14 Drawing Sheets

PORTABLE FOLDING OUTDOOR TABLE

TECHNICAL FIELD

The present disclosure relates to the field of outdoor tables, and in particular to a portable folding outdoor table.

BACKGROUND

With the improvement of people's living standards, there are more and more private cars. On holidays and festivals, people often drive out to take holidays. In outdoor activities, tables and chairs convenient to carry are specially needed to put things and have a rest. Some existing outdoor tables occupy a large space when being stored, and are inconvenient to load and transport by the private cars, and carry.

SUMMARY

(I) The Technical Problem to be Solved

The problem to be solved by the present disclosure is to provide a portable folding outdoor table, where a table board assembly and a supporting leg assembly are convenient to disassemble and assemble and convenient to use. The table board assembly can be turned and folded when the portable folding outdoor table is stored, so that the portable folding outdoor table occupies a small space and is convenient to transport and carry. A plurality of table board assemblies can be stably spliced, so that a usable area of the portable folding outdoor table is expanded, and a usage experience is excellent.

(II) Technical Solution

To solve the technical problem, the present disclosure provides a portable folding outdoor table, including a table board assembly, and a supporting leg assembly detachably connected to the table board assembly, where the table board assembly includes a first table board, and a second table board hinged with the first table board; a hinged locating mechanism is arranged between the first table board and the second table board; the hinged locating mechanism includes a first planar hinged board, a second planar hinged board, a first locating hinged board and a second locating hinged board; the first planar hinged board is fixedly connected to the first table board; the second planar hinged board is fixedly connected to the second table board; the second planar hinged board is hinged with the first planar hinged board; the first locating hinged board is hinged to a side end of the first planar hinged board; the second locating hinged board is hinged to a side end of the second planar hinged board; and the first locating hinged board is hinged with the second locating hinged board. According to the portable folding outdoor table provided by the present disclosure, the table board assembly and the supporting leg assembly are convenient to disassemble and assemble and convenient to use. The table board assembly can be turned and folded when the portable folding outdoor table is stored, so that the portable folding outdoor table occupies a small space and is convenient to transport and carry. A plurality of table board assemblies can be stably spliced, so that a usable area of the portable folding outdoor table is expanded, and a usage experience is excellent.

Further, a first torsional spring and a first hinged shaft are arranged between the first planar hinged board and the first locating hinged board, the first planar hinged board is hinged with the first locating hinged board through the first hinged shaft, the first torsional spring is sleeved on the first hinged shaft, and the first torsional spring is used to drive the first locating hinged board to turn toward one side of the first planar hinged board; and when the first locating hinged board is turned to be perpendicular to the first planar hinged board, the first locating hinged board abuts against the first planar hinged board to be located.

Further, a second torsional spring and a second hinged shaft are arranged between the second planar hinged board and the second locating hinged board, the second planar hinged board is hinged with the second locating hinged board through the second hinged shaft, the second torsional spring is sleeved on the second hinged shaft, and the second torsional spring is used to drive the second locating hinged board to turn toward one side of the second planar hinged board; and when the second locating hinged board is turned to be perpendicular to the second planar hinged board, the second locating hinged board abuts against the second planar hinged board to be located.

Further, a third torsional spring and a third hinged shaft are arranged between the first planar hinged board and the second planar hinged board, the first planar hinged board is hinged with the second planar hinged board through the third hinged shaft, the third torsional spring is sleeved on the third hinged shaft, and the third torsional spring is used to drive the first planar hinged board and the second planar hinged board to turn and fold.

Further, a fourth torsional spring and a fourth hinged shaft are arranged between the first locating hinged board and the second locating hinged board, the first locating hinged board is hinged with the second locating hinged board through the fourth hinged shaft, the fourth torsional spring is sleeved on the fourth hinged shaft, and the fourth torsional spring is used to drive the first locating hinged board and the second locating hinged board to turn and fold.

Further, a fast disassembling and assembling mechanism is arranged between the supporting leg assembly and the table board assembly; the fast disassembling and assembling mechanism includes a plurality of locking handles and snap fasteners corresponding to the locking handles; the locking handles are rotatably arranged on the table board assembly; the snap fasteners are fixedly arranged on the supporting leg assembly; each of the locking handles includes a handle and an arc-shaped clamping board; and a first clamping groove corresponding to the clamping board is formed in the snap fastener.

Further, a clamping block is arranged on the snap fastener, and a second clamping groove corresponding to the clamping block is formed in the table board assembly.

Further, the table board assembly is in a shape of a cuboid; four locking handles are arranged; a quantity of the snap fasteners is identical to a quantity of the locking handles; the snap fastener is arranged on an upper portion of the supporting leg assembly; and the four locking handles are respectively arranged at four corner positions of a bottom of the table board assembly.

Further, the supporting leg assembly includes an upper support, a lower support, upper supporting legs and lower supporting legs; the upper support is arranged above the lower support; a plurality of upper supporting legs are arranged; lower ends of the upper supporting legs are hinged to the lower support; a plurality of lower supporting legs are arranged; upper ends of the lower supporting legs are hinged to the upper support; the upper supporting legs and the lower supporting legs are identical in quantity and correspond one by one; and the upper supporting legs are hinged with the corresponding lower supporting legs.

Further, a first handle is arranged on a side, away from the second table board, of the first table board, and a second handle is arranged on a side, away from the first table board, of the second table board.

Further, a lap fastener is arranged on one side of the table board assembly; a catching groove is formed in a side, away from the lap fastener, of the table board assembly; and the catching groove corresponds to the lap fastener.

(III) Beneficial Effects

According to the portable folding outdoor table provided by the present disclosure, the table board assembly and the supporting leg assembly are convenient to disassemble and assemble and convenient to use. The table board assembly can be turned and folded when the portable folding outdoor table is stored, so that the portable folding outdoor table occupies a small space and is convenient to transport and carry. A plurality of table board assemblies can be stably spliced, so that the usable area of the portable folding outdoor table is expanded, and the usage experience is excellent. The first planar hinged board and the second planar hinged board are located by means of supporting forces of the first locating hinged board and the second locating hinged board, so that the first planar hinged board and the second planar hinged board cannot turn, and therefore, a structural stability of the first table board and the second table board in use is improved. The third torsional spring and the fourth torsional spring can assist to drive the first table board and the second table board to be folded together, so that it is more convenient and labor-saving to fold the first table board and the second table board. When the supporting leg assembly and the table board assembly are assembled, the clamping block is first clamped into the second clamping groove, and then the clamping board is correspondingly clamped into the first clamping groove by rotating the handle to lock the supporting leg assembly and the table board assembly, so that the structural stability is further improved. The four locking handles are respectively arranged at four corner positions of the bottom of the table board assembly. The supporting leg assembly supports the four corner positions of the table board assembly, so that the table board assembly is unlikely to topple, and the supporting effect is good. The supporting leg assembly can better support the table board assembly after being unfolded, occupies a small space after being folded and stored, and is convenient to transport and carry. The first table board and the second table board are folded when the table is stored, and in this case, the folded table board assembly is convenient to lift and take through the first handle and the second handle, so that it is convenient to carry.

Figure 1:
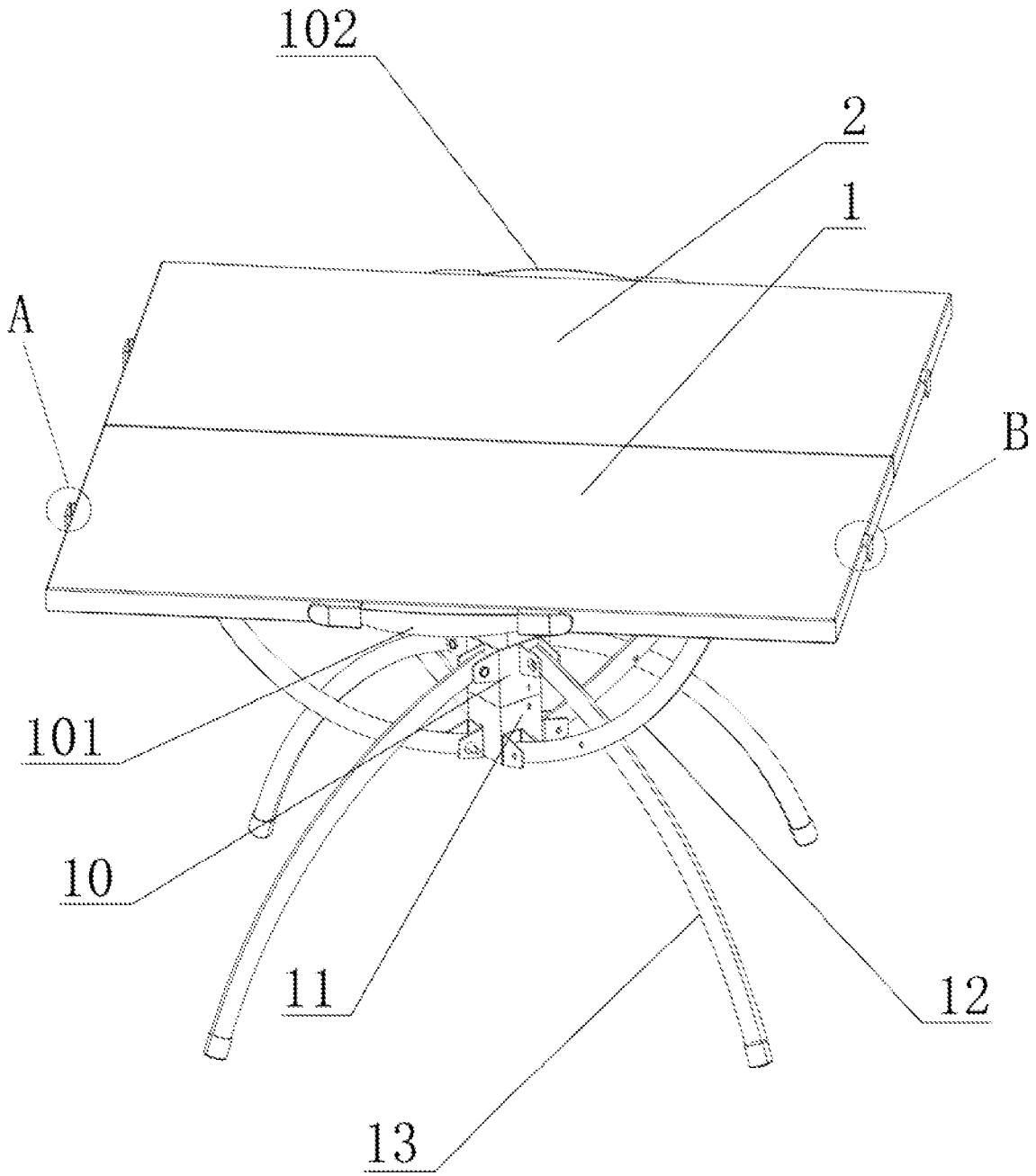
FIG. 1 is a stereogram of a portable folding outdoor table of the present disclosure.
Figure 2:
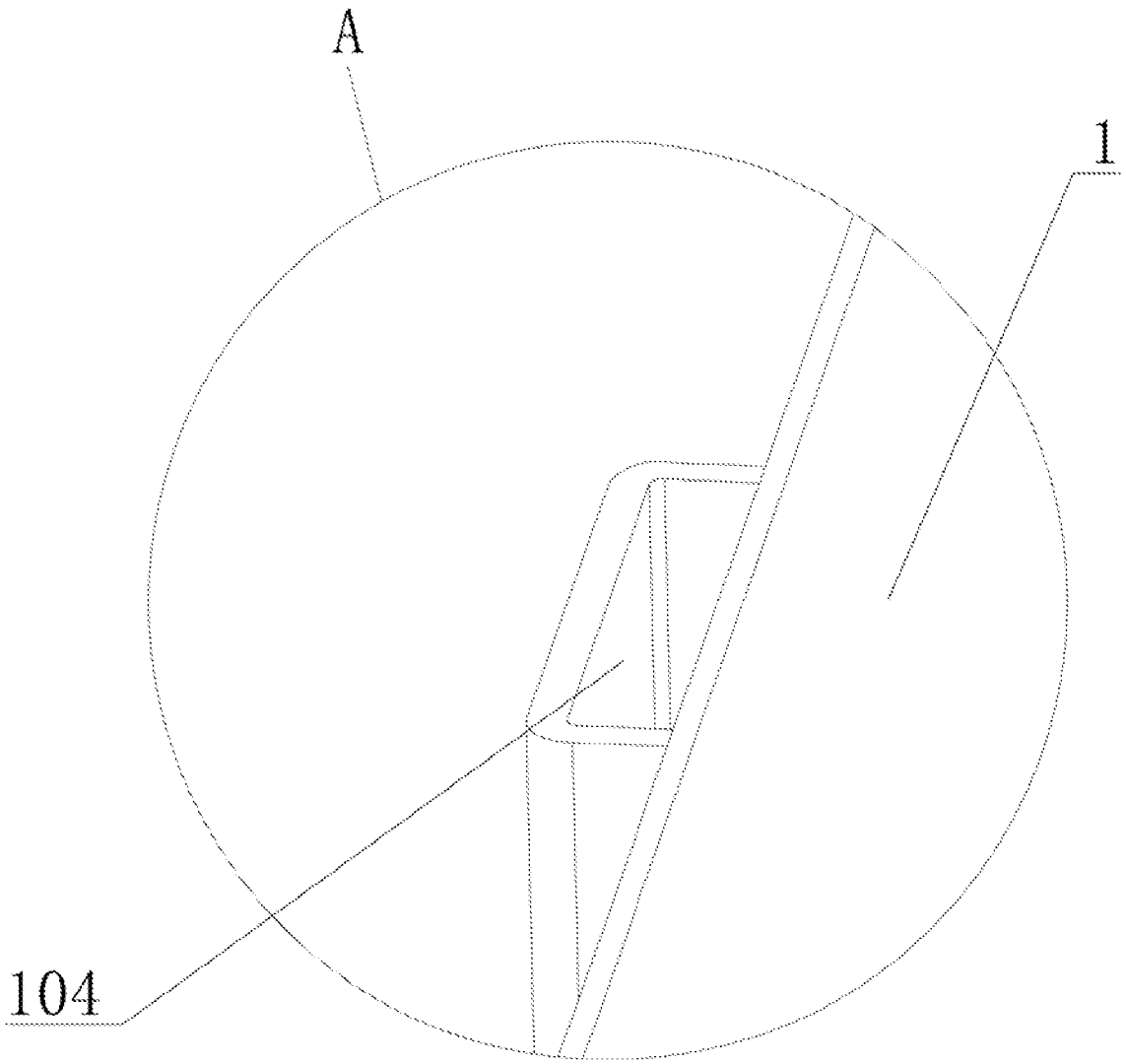
FIG. 2 is an enlarged view of a portion A in FIG. 1.
Figure 3:
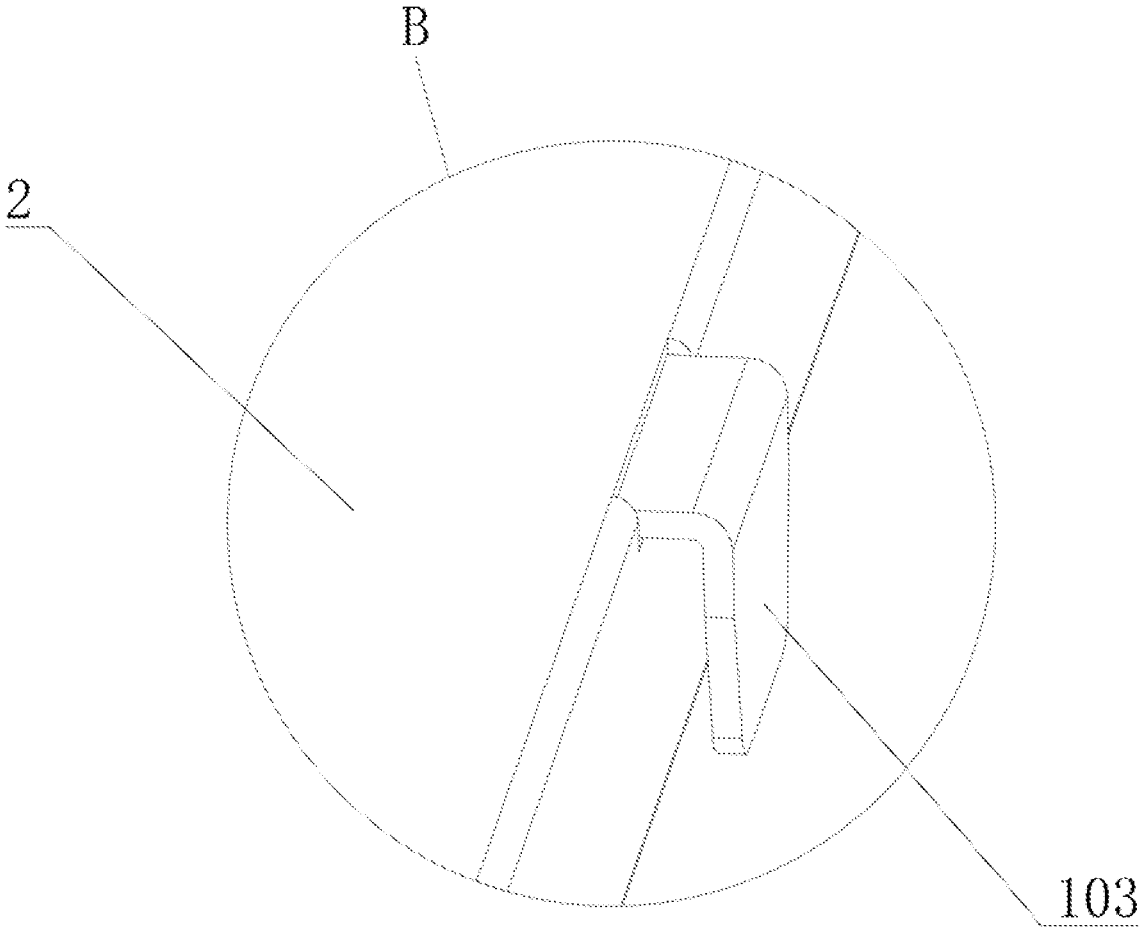
FIG. 3 is an enlarged view of a portion B in FIG. 1.
Figure 4:
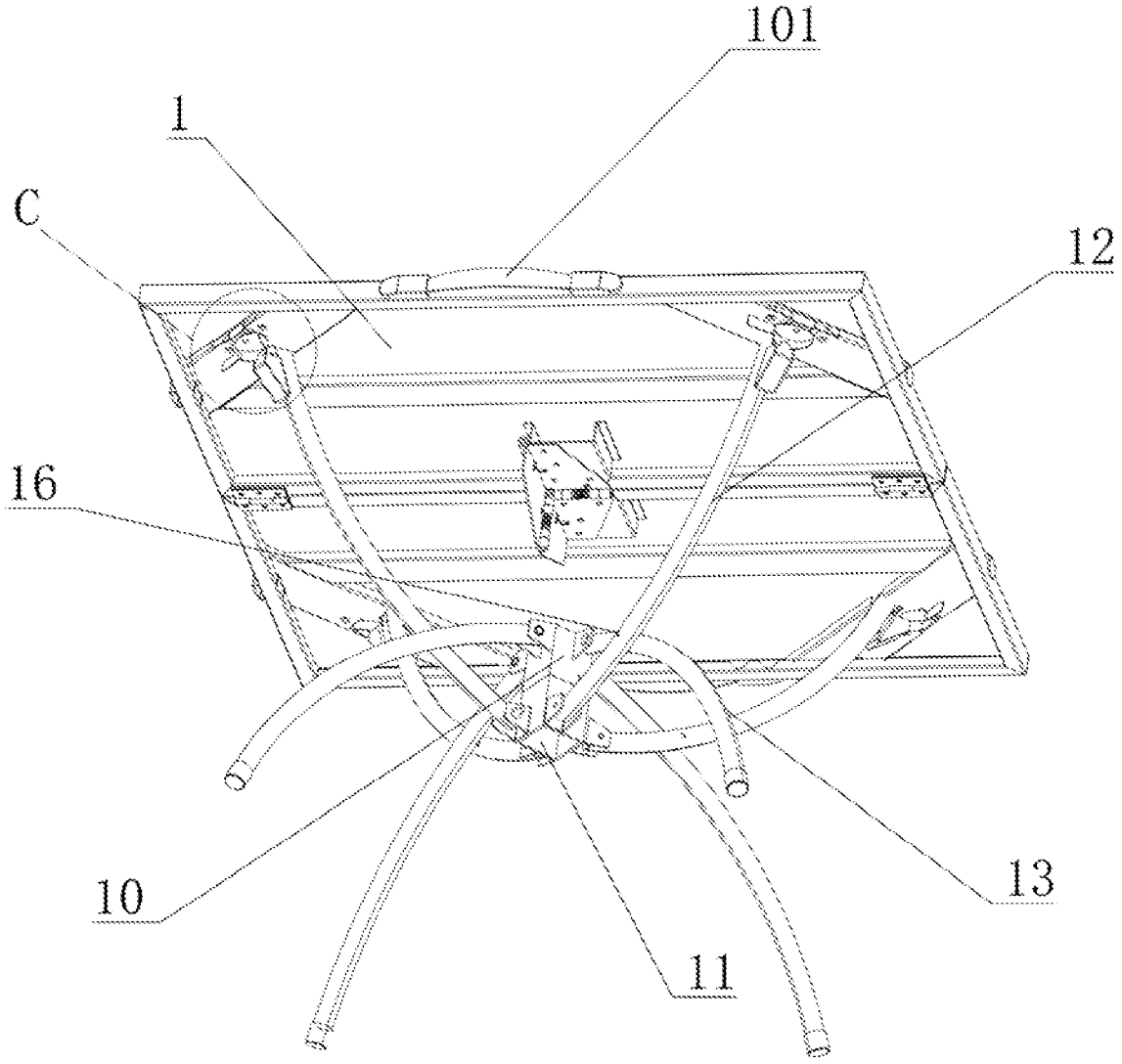
FIG. 4 is a stereogram of a bottom of the portable folding outdoor table of the present disclosure.
Figure 5:
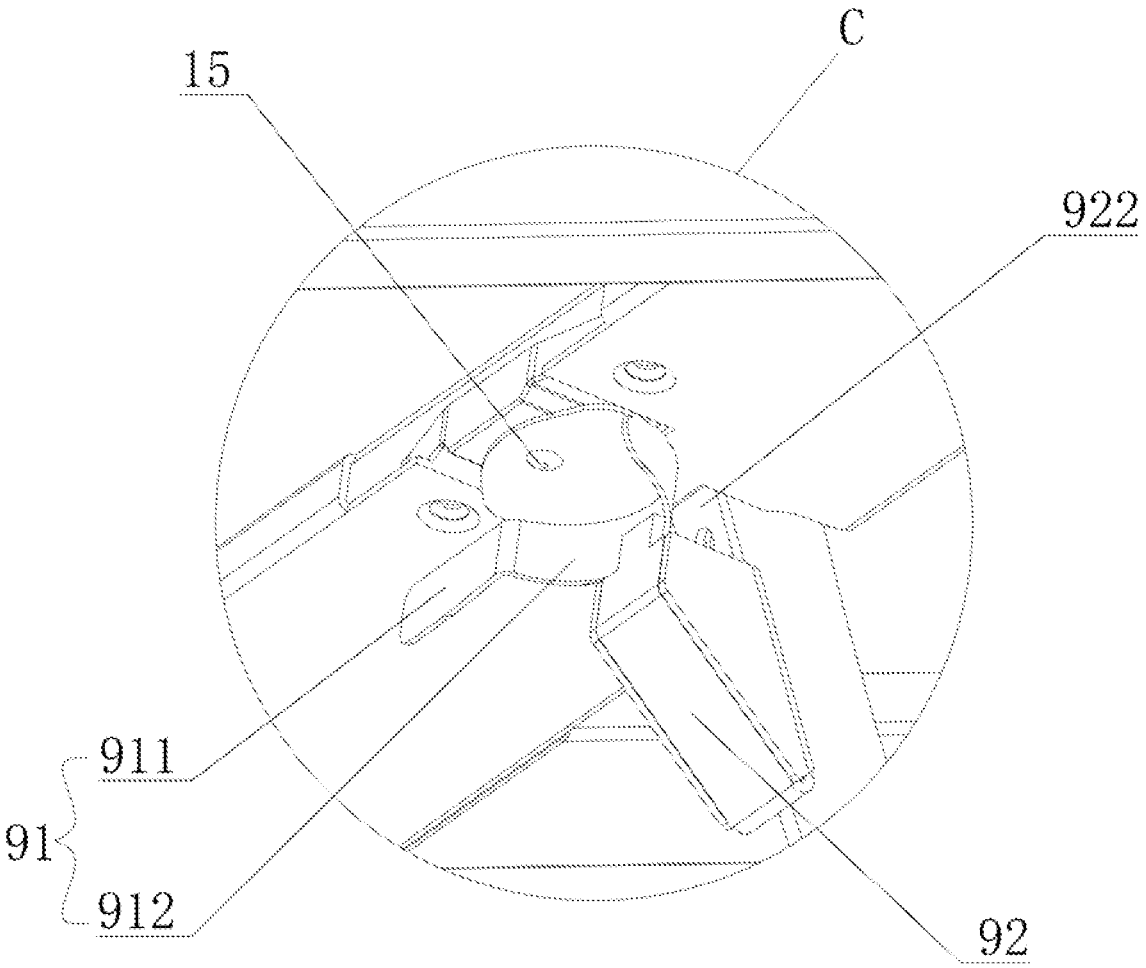
FIG. 5 is an enlarged view of a portion C in FIG. 4.
Figure 6:
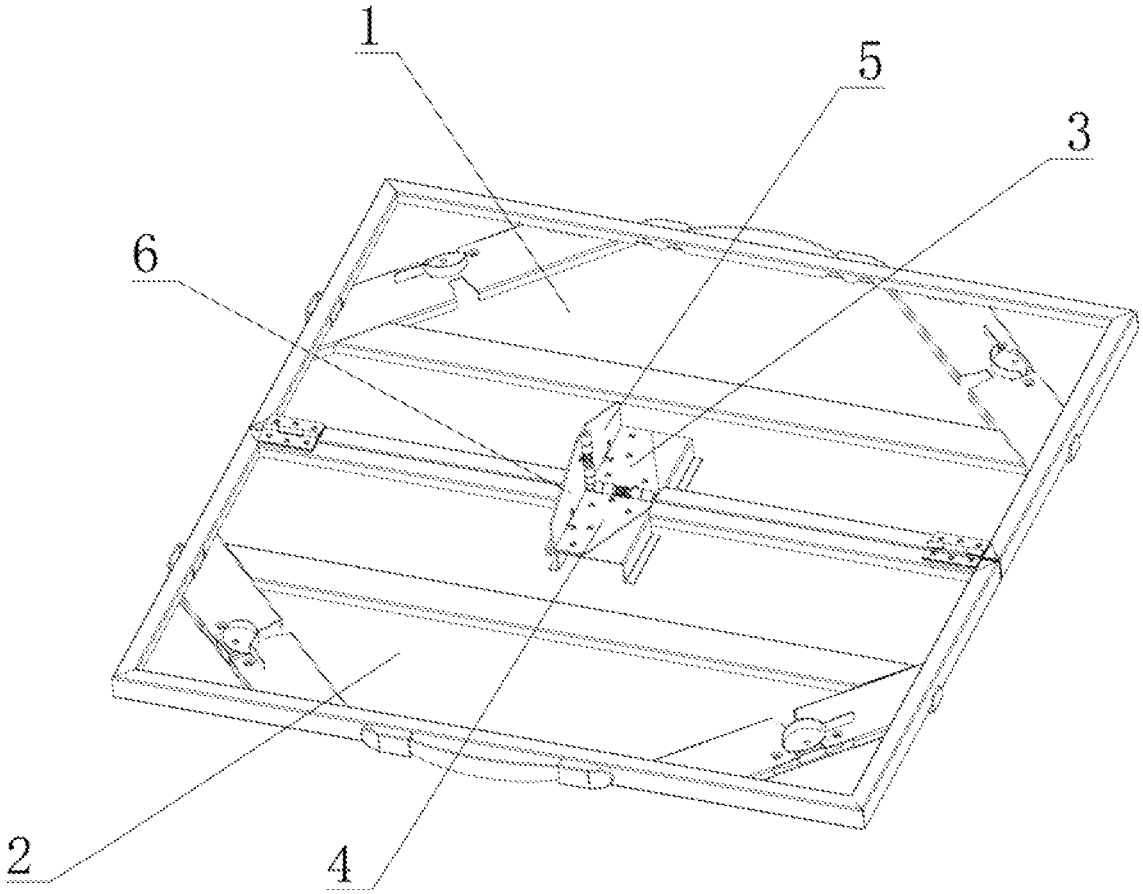
FIG. 6 is a schematic structural diagram of a table board assembly of the portable folding outdoor table of the present disclosure.
Figure 7:
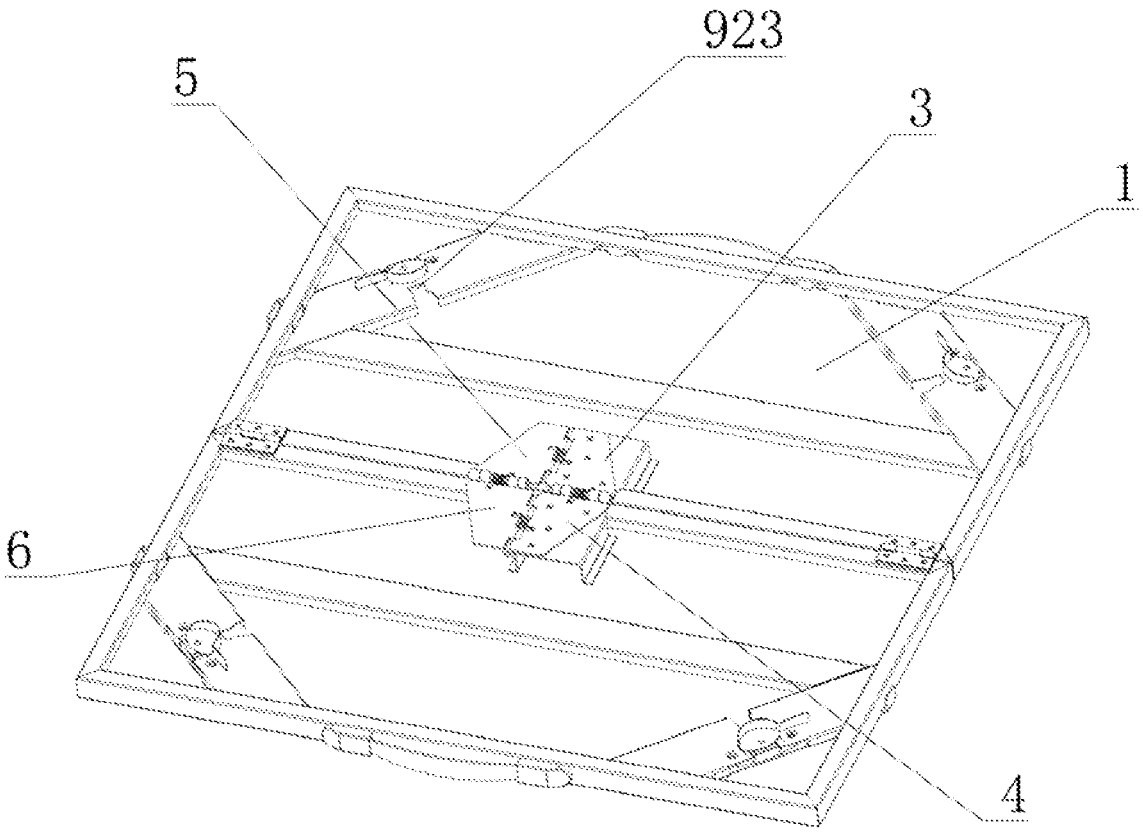
FIG. 7 is a schematic structural diagram of the portable folding outdoor table of the present disclosure with a first locating hinged board and a second locating hinged board being in an unfolded state.

Names of components corresponding to numerals in the drawings: 1, first table board; 101, first handle; 102, second handle; 103, lap fastener; 104, catching groove; 2, second table board; 3, first planar hinged board; 4, second planar hinged board; 5, first locating hinged board; 6, second locating hinged board; 71, first torsional spring; 72, second torsional spring; 73, third torsional spring; 74, fourth torsional spring; 81, first hinged shaft; 82, second hinged shaft; 83, third hinged shaft; 84, fourth hinged shaft; 91, locking handle; 911, handle; 912, clamping board; 92, snap fastener; 921, first clamping groove; 922, clamping block; 923, second clamping groove; 10, upper support; 11, lower support; 12, upper supporting leg; 13, lower supporting leg; 14, hinge; 15, rotating shaft; and 16, fifth hinged shaft.

DETAILED DESCRIPTION

The specific implementations of the present disclosure will be further described in detail with reference to the drawings and the embodiments. The following embodiments are used for describing the present disclosure, but are not used for limiting the scope of the present disclosure.

Referring to FIG. 1-FIG. 14, the present disclosure provides a portable folding outdoor table, including a table board assembly, and a supporting leg assembly detachably connected to the table board assembly. The table board assembly includes a first table board 1, and a second table board 2 hinged with the first table board 1, where shapes and sizes of table tops of the first table board 1 and the second table board 2 are identical, and the first table board 1 is hinged with the second table board 2 through a hinge 14; a hinged locating mechanism is arranged between the first table board 1 and the second table board 2; the hinged locating mechanism includes a first planar hinged board 3, a second planar hinged board 4, a first locating hinged board 5 and a second locating hinged board 6; the first planar hinged board 3 is fixedly connected to the first table board 1; the second planar hinged board 4 is fixedly connected to the second table board 2; the second planar hinged board 4 is hinged with the first planar hinged board 3; the first locating hinged board 5 is hinged to a side end of the first planar hinged board 3; the second locating hinged board 6 is hinged to a side end of the second planar hinged board 4; and the first locating hinged board 5 is hinged with the second locating hinged board 6. According to the portable folding outdoor table provided by the present disclosure, the table board assembly and the supporting leg assembly are convenient to disassemble and assemble and convenient to use. The table board assembly can be turned and folded when the portable folding outdoor table is stored, so that the portable folding outdoor table occupies a small space and is convenient to transport and carry. A plurality of table board assemblies can be stably spliced, so that a usable area of the portable folding outdoor table is expanded, and a usage experience is excellent. During use, the first table board 1 and the second table board 2 are turned to be fully unfolded, and in this case, the table tops of the first table board 1 and the second table board 2 are coplanar; the first planar hinged board 3 and the second planar hinged board 4 are in a coplanar state, then the first locating hinged board 5 is turned to a state where the first locating hinged board is perpendicular to the first planar hinged board 3, and moreover, the second locating hinged board 6 is turned to a state where the second locating hinged board is perpendicular to the second planar hinged board 4; in this case, the first planar hinged board 3 and the second planar hinged board 4 are located by means of supporting forces of the first locating hinged board 5 and the second locating hinged board 6, that is, the first table board 1 and the second table board 2 are located, so that the first planar hinged board 3 and the second planar hinged board 4 cannot turn, and therefore, a structural stability of the first table board 1 and the second table board 2 in use is improved; and when it is needed to be stored, the first locating hinged board 5 is first turned to be coplanar with the first planar hinged board 3, and moreover, the second locating hinged board 6 is turned to be coplanar with the second planar hinged board 4, and in this case, locating of the first planar hinged board 3 and the second planar hinged board 4 is relieved, and then the first table board 1 and the second table board 2 are folded and turned to reduce the occupied space for the convenience of storage and carrying.

Referring to FIG. 4, FIG. 6, FIG. 7, FIG. 8 and FIG. 9, a first torsional spring 71 and a first hinged shaft 81 are arranged between the first planar hinged board 3 and the first locating hinged board 5, the first planar hinged board 3 is hinged with the first locating hinged board 5 through the first hinged shaft 81, the first torsional spring 71 is sleeved on the first hinged shaft 81, and the first torsional spring 71 is used to drive the first locating hinged board 5 to turn toward one side of the first planar hinged board 3; and when the first locating hinged board 5 is turned to be perpendicular to the first planar hinged board 3, an upper portion of the first locating hinged board 5 abuts against the first planar hinged board 3 to keep a state where the first locating hinged board 5 is perpendicular to the first planar hinged board 3; a second torsional spring 72 and a second hinged shaft 82 are arranged between the second planar hinged board 4 and the second locating hinged board 6, the second planar hinged board 4 is hinged with the second locating hinged board 6 through the second hinged shaft 82, the second torsional spring 72 is sleeved on the second hinged shaft 82, and the second torsional spring 72 is used to drive the second locating hinged board 6 to turn toward one side of the second planar hinged board 4; and when the second locating hinged board 6 is turned to be perpendicular to the second planar hinged board 4, an upper portion of the second locating hinged board 6 abuts against the second planar hinged board 4 to be located to keep a state where the second locating hinged board 6 is perpendicular to the second planar hinged board 4; a third torsional spring 73 and a third hinged shaft 83 are arranged between the first planar hinged board 3 and the second planar hinged board 4, the first planar hinged board 3 is hinged with the second planar hinged board 4 through the third hinged shaft 83, the third torsional spring 73 is sleeved on the third hinged shaft 83, the first locating hinged board 5 is first turned to be coplanar with the third planar hinged board 3, and moreover, the second locating hinged board 6 is turned to be coplanar with the second planar hinged board 4 during storage, so that the first locating hinged board and the second first locating hinged board are in an unfolded state, and in this case, the third torsional spring 73 is used to drive the first planar hinged board 3 and the second planar hinged board 4 to turn and fold, that is, the third torsional spring 73 can assist to drive the first table board 1 and the second table board 2 to be folded together, so that it is more convenient and labor-saving to fold the first table board 1 and the second table board 2; a fourth torsional spring 74 and a fourth hinged shaft 84 are arranged between the first locating hinged board 5 and the second locating hinged board 6, the first locating hinged board 5 is hinged with the second locating hinged board 6 through the fourth hinged shaft 84, the fourth torsional spring 74 is sleeved on the fourth hinged shaft 84, the first locating hinged board 5 is first turned to be coplanar with the first planar hinged board 3, and moreover, the second locating hinged board 6 is turned to be coplanar with the second planar hinged board 4 during storage, and in this case, the fourth torsional spring 74 is used to drive the first locating hinged board 5 and the second locating hinged board 6 to turn and fold, that is, the fourth torsional spring 74 can assist to drive the first table board 1 and the second table board 2 to be folded together, so that it is more convenient and labor-saving to fold the first table board 1 and the second table board 2.

Referring to FIG. 4, FIG. 5, FIG. 7, FIG. 11 and FIG. 12, a fast disassembling and assembling mechanism is arranged between the supporting leg assembly and the table board assembly; the fast disassembling and assembling mechanism includes a plurality of locking handles 91 and snap fasteners 92 corresponding to the locking handles 91; the locking handles 91 are rotatably arranged on the table board assembly through a rotating shaft 15; the snap fasteners 92 are fixedly arranged on the supporting leg assembly; each of the locking handles 91 includes a handle 911 and an arc-shaped clamping board 912, where the clamping board 912 and the handle 911 are integrally formed, and a first clamping groove 921 corresponding to the clamping board 912 is formed in the snap fastener 92. When the supporting leg assembly and the table board assembly are assembled, the clamping board 912 is correspondingly clamped into the first clamping groove 921 by rotating the handle 911 to lock the supporting leg assembly and the table board assembly, so that the structure is stable in the using process, and misdisengagement between the supporting leg assembly and the table board assembly is avoided; when it is needed to split the supporting leg assembly and the table board assembly, the clamping board 912 is disengaged from the first clamping groove 921 correspondingly by reversely rotating the handle 911 to unlock the supporting leg assembly and the table board assembly with convenient operations; a clamping block 922 is arranged on the snap fastener 92; a second clamping groove 923 corresponding to the clamping block 922 is formed in the table board assembly; when the supporting leg assembly and the table board assembly are assembled, the clamping block 922 is first clamped into the second clamping groove 923, and then the clamping board 912 is correspondingly clamped into the first clamping groove 921 by rotating the handle 911 to lock the supporting leg assembly and the table board assembly, so that the structural stability is further improved; the table board assembly is in a shape of a cuboid, four locking handles 91 are arranged, a quantity of the snap fasteners 92 is identical to a quantity of the locking handles 91, the snap fastener 92 is arranged on an upper portion of the supporting leg assembly, the four locking handles 91 are respectively arranged at four corner positions of a bottom of the table board assembly, and the supporting leg assembly supports the four corner positions of the table board assembly, so that the table board assembly is unlikely to topple, and the supporting effect is good.

Figure 11:
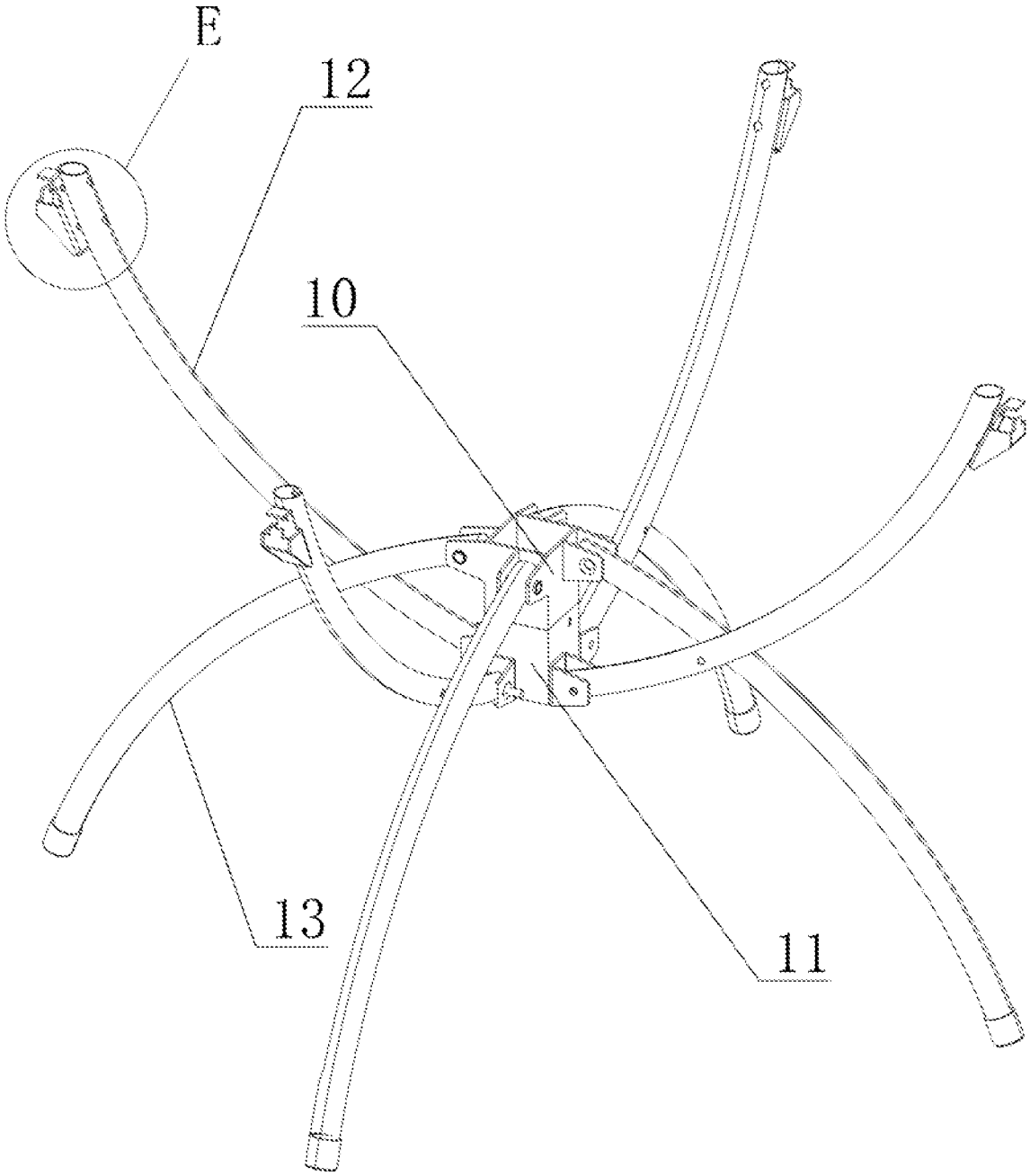
FIG. 11 is a schematic structural diagram of a supporting leg assembly of the portable folding outdoor table of the present disclosure in an unfolded state.
Figure 12:
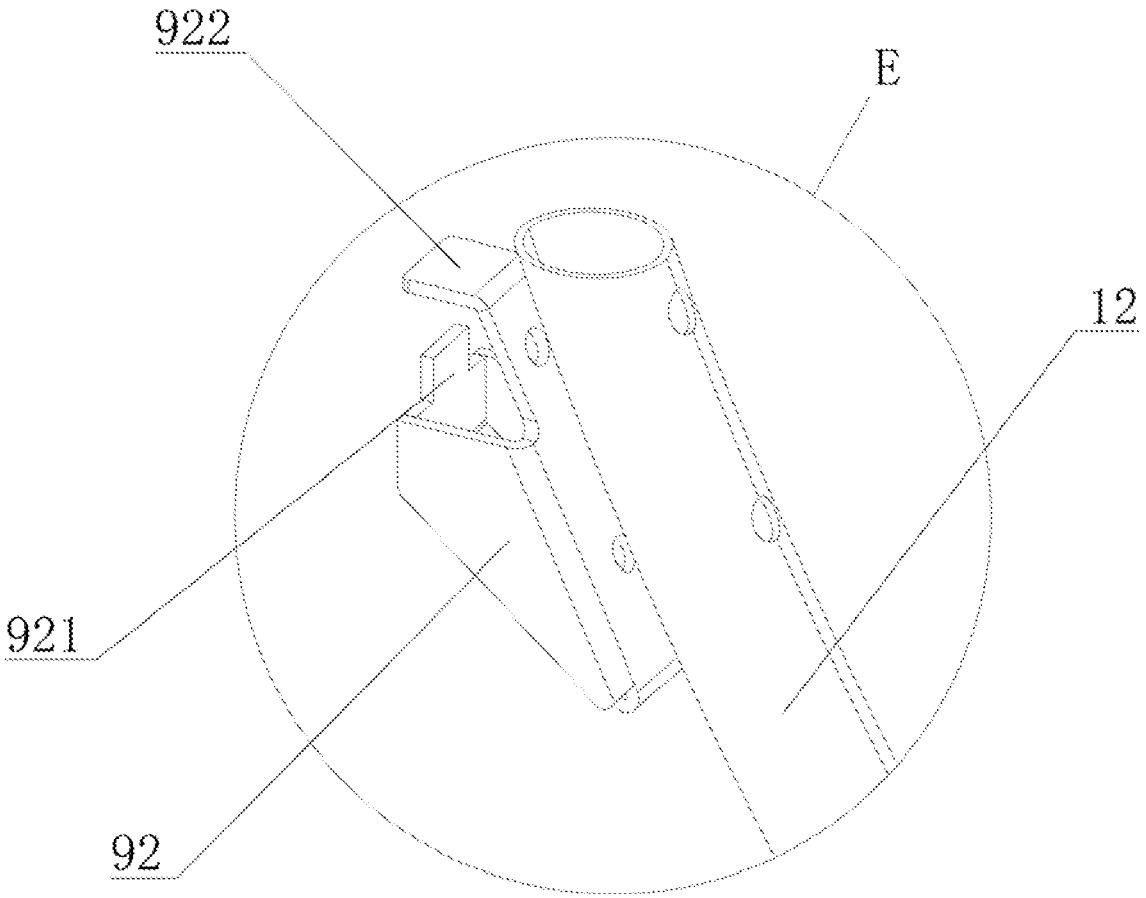
FIG. 12 is an enlarged view of a portion E in FIG. 11.
Figure 13:
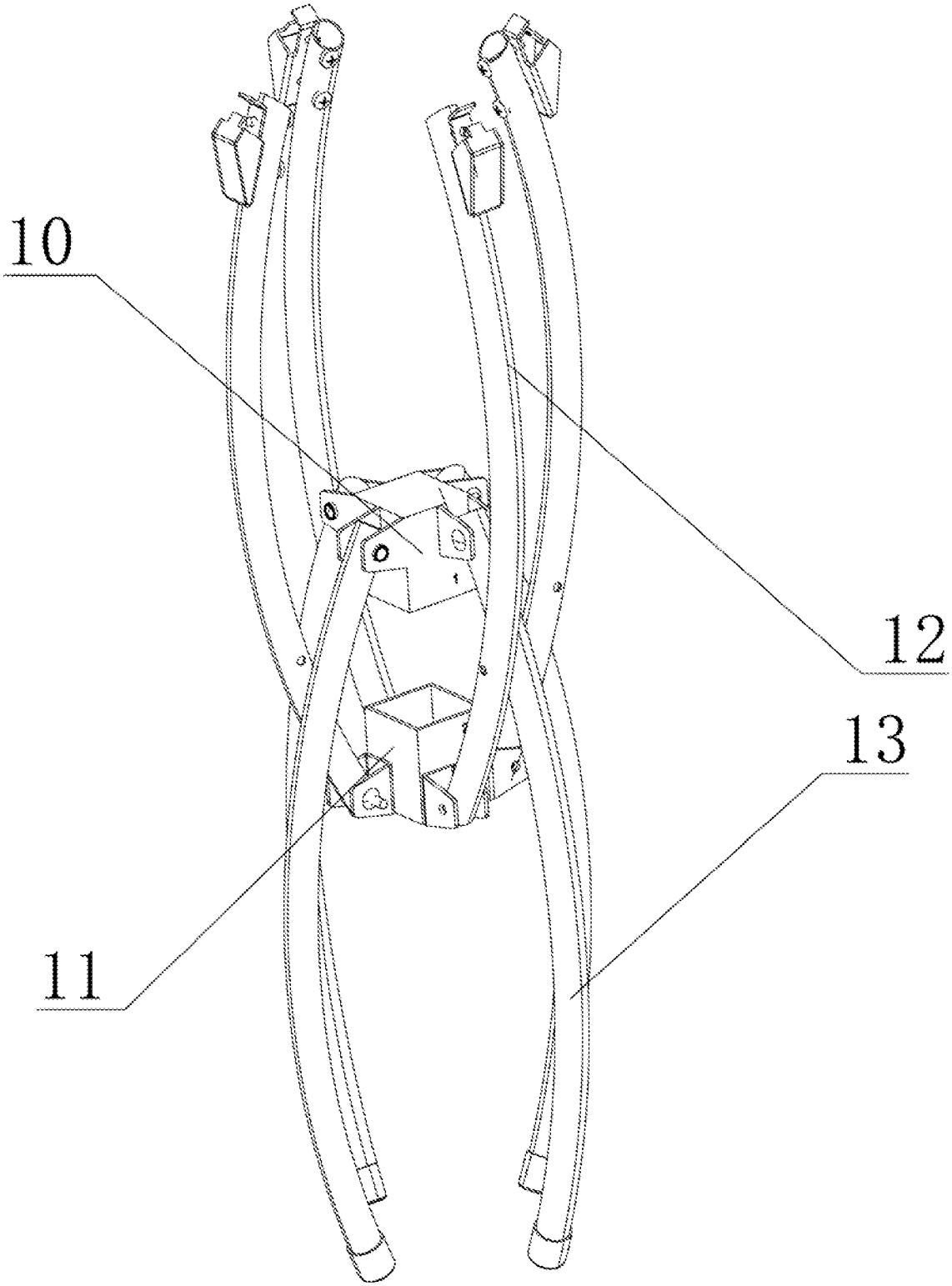
FIG. 13 is a schematic structural diagram of the supporting leg assembly of the portable folding outdoor table of the present disclosure in a stored state.
Figure 14:
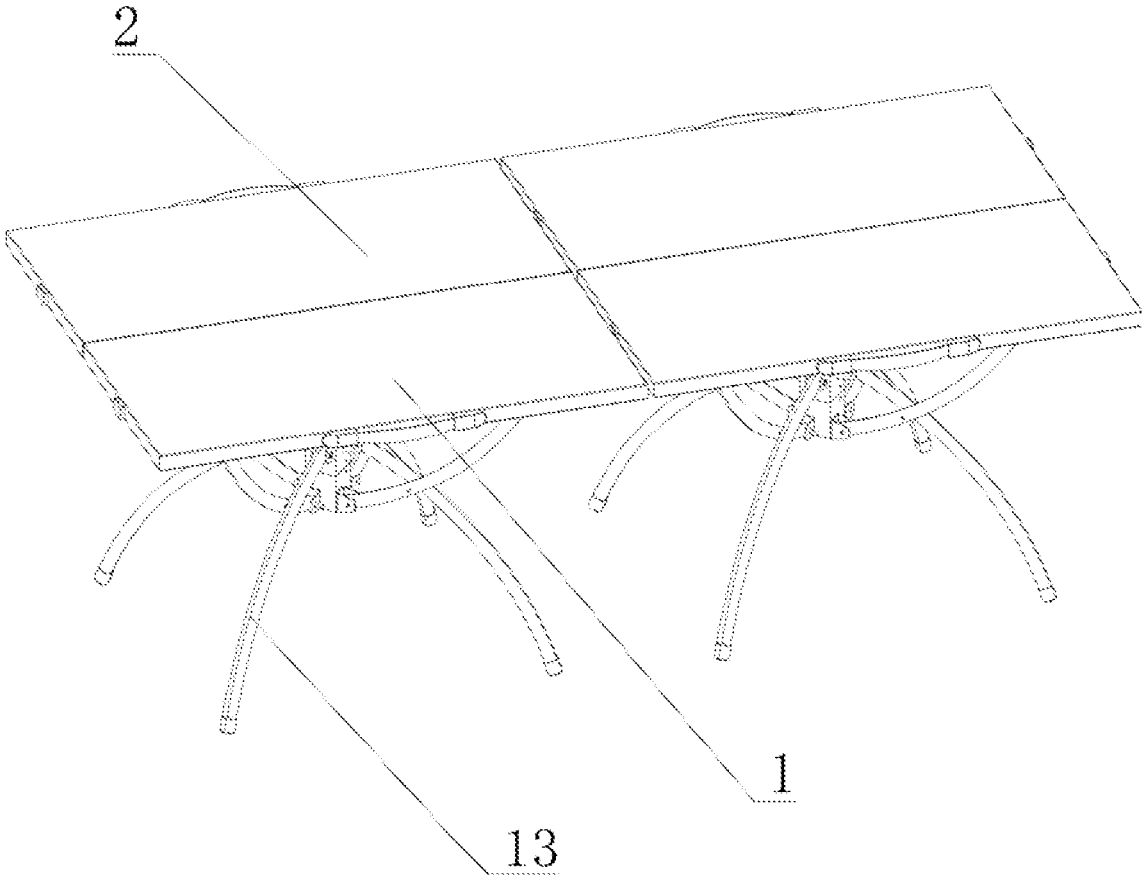
FIG. 14 is a schematic structural diagram of the portable folding outdoor table of the present disclosure when a plurality of table board assemblies are spliced.

Referring to FIG. 1, FIG. 11 and FIG. 13, the supporting leg assembly includes an upper support 10, a lower support 11, upper supporting legs 12 and lower supporting legs 13, where the upper support 10 is arranged above the lower support 11; a plurality of upper supporting legs 12 are arranged; lower ends of the upper supporting legs 12 are hinged to the lower support 11; a plurality of lower supporting legs 13 are arranged; upper ends of the lower supporting legs 13 are hinged to the upper support 10; the upper supporting legs 12 and the lower supporting legs 13 are identical in quantity and correspond one by one; and the upper supporting legs 12 are hinged with the corresponding lower supporting legs 13 on a fifth hinged shaft 16, so that the supporting leg assembly has two states: unfolded to use and folded to store. In the embodiment, four upper supporting legs 12 and four lower supporting legs 13 are arranged; when the supporting leg assembly is unfolded, upper portions of two upper supporting legs 12 at any diagonal positions are forced apart outwards until a lower end of the upper support 10 abuts against an upper end of the lower support 11 to limit, and in this case, an unfolding action is completed; during storage, the upper portions of two upper supporting legs 12 at any diagonal positions are gathered inwards with convenient operations; and the supporting leg assembly can better support the table board assembly after being unfolded, occupies a small space after being folded and stored, and is convenient to transport and carry.

Figure 8:
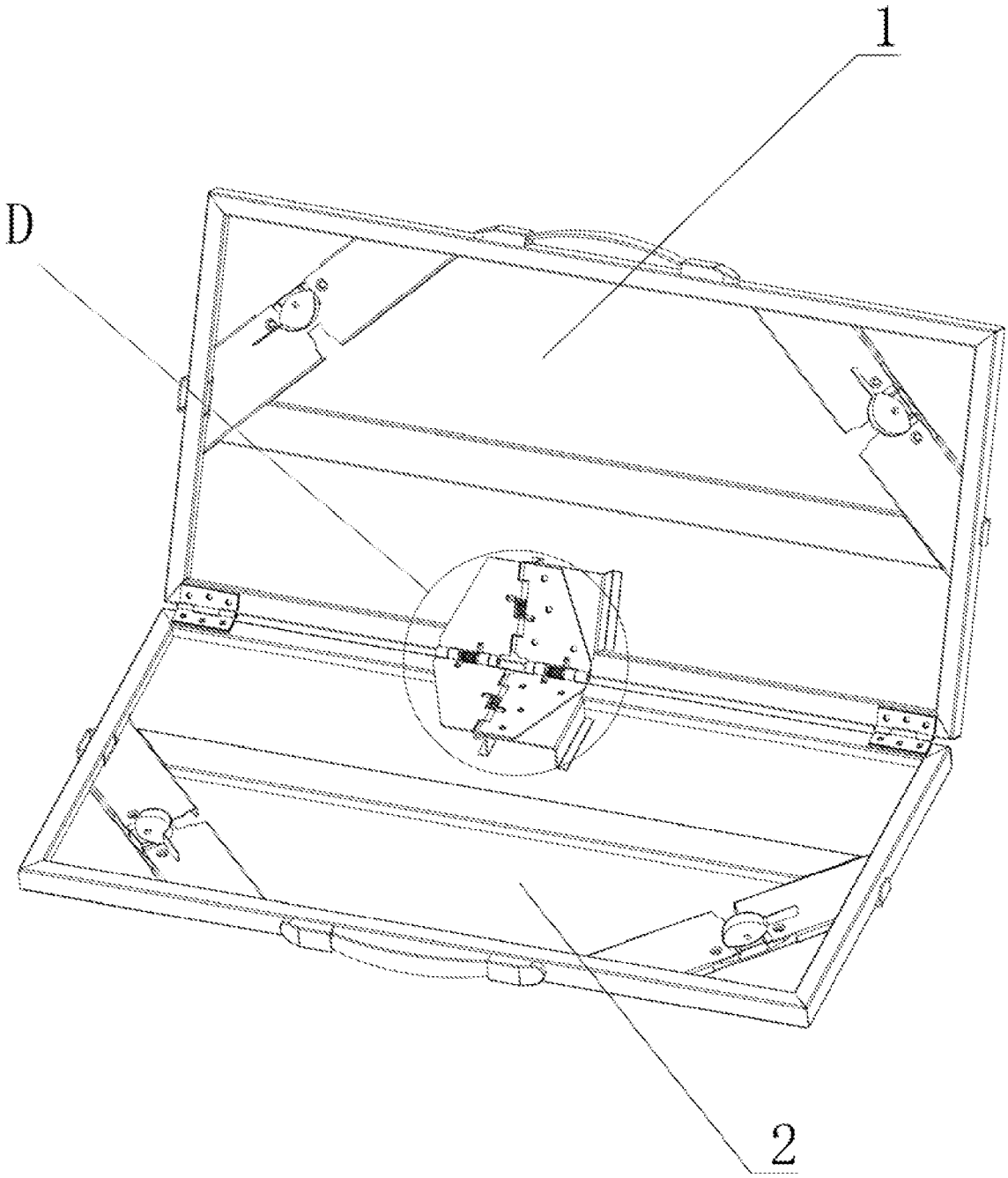
FIG. 8 is a schematic structural diagram in a process of folding the table board assembly of the portable folding outdoor table of the present disclosure.
Figure 9:
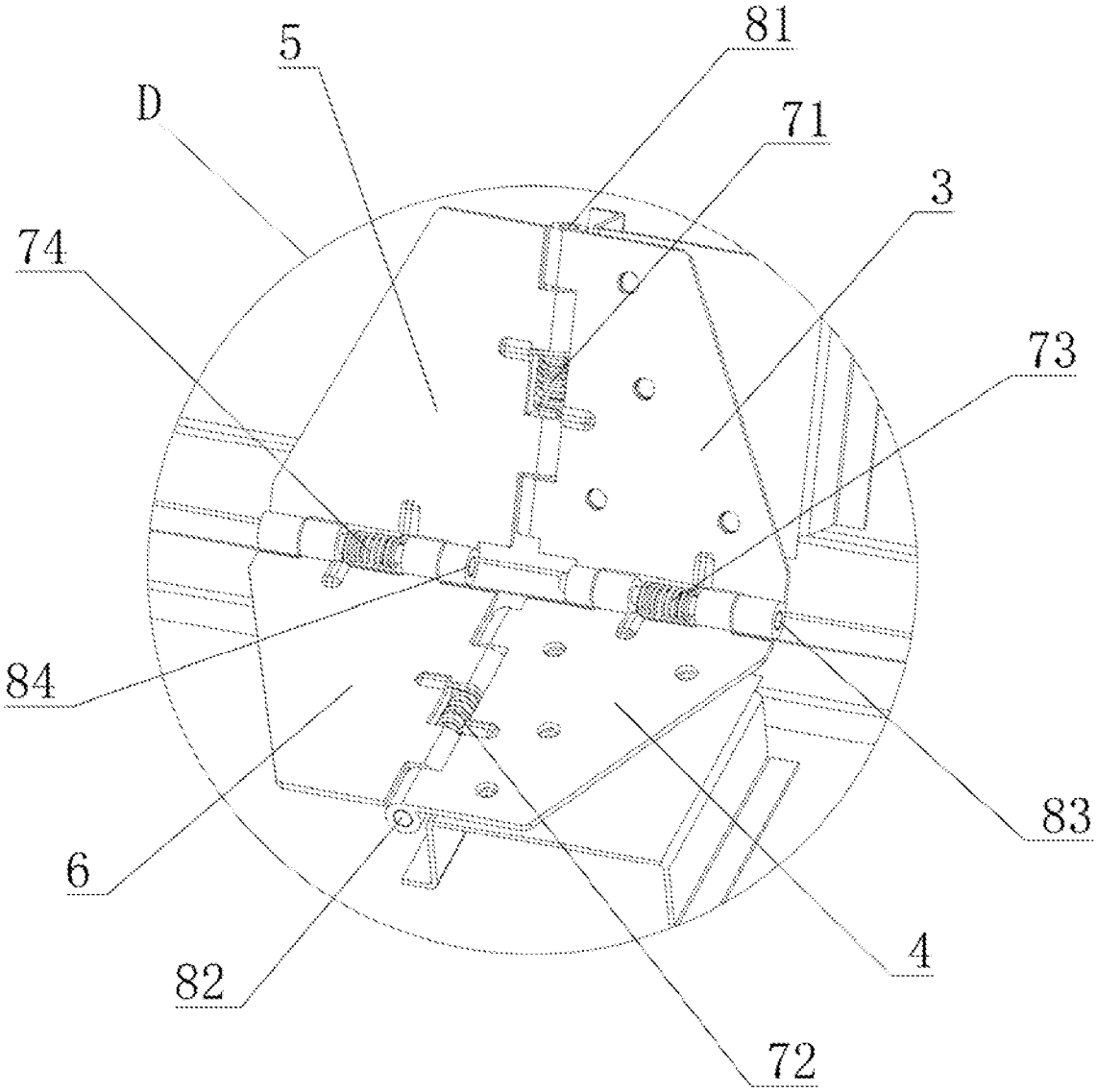
FIG. 9 is an enlarged view of a portion D in FIG. 8.
Figure 10:
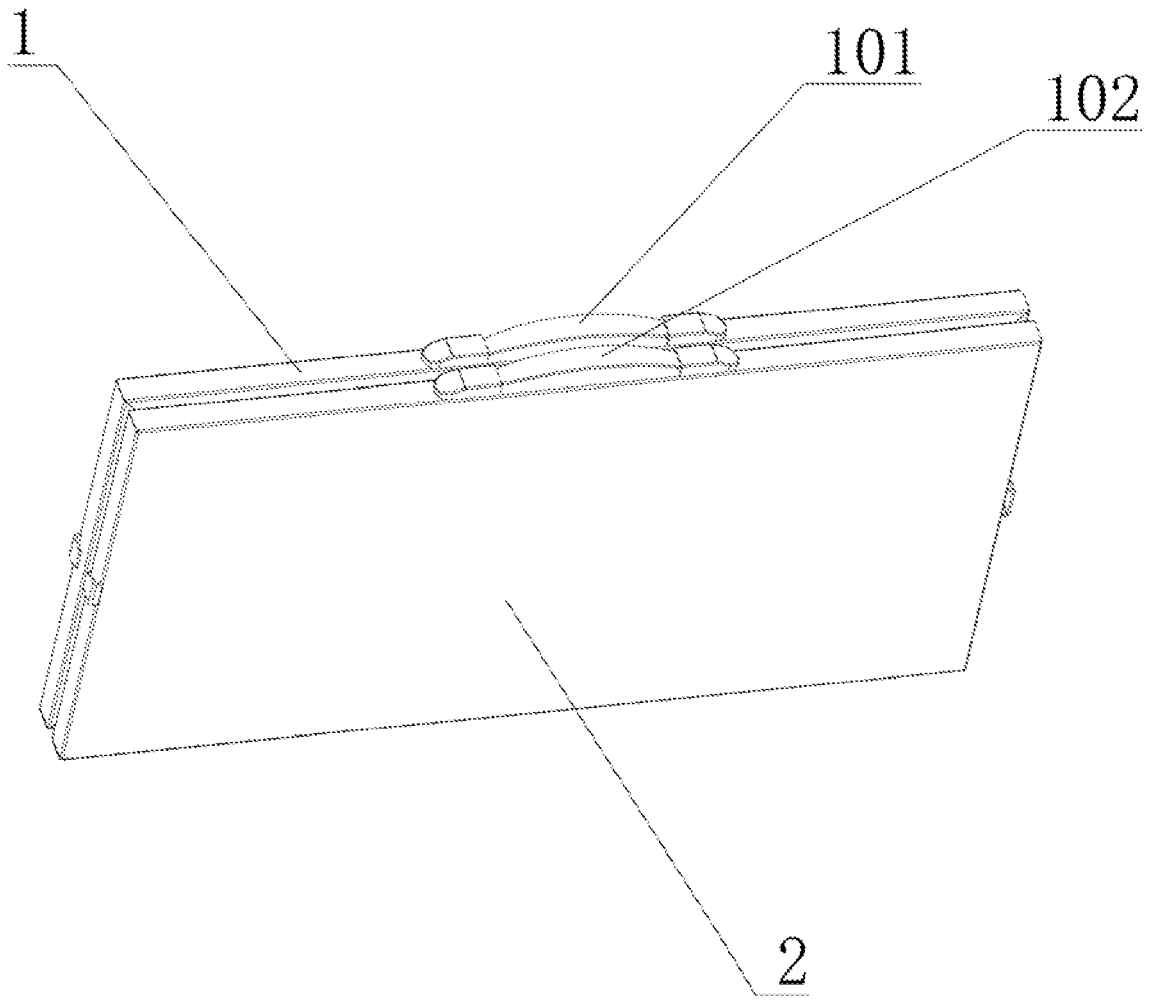
FIG. 10 is a schematic structural diagram of the fully folded table board assembly of the portable folding outdoor table of the present disclosure.

Referring to FIG. 1, FIG. 8 and FIG. 10, a first handle 101 is arranged on a side, away from the second table board 2, of the first table board 1, and a second handle 102 is arranged on a side, away from the first table board 1, of the second table board 2. During storage, the first table board 1 and the second table board 2 are folded, and in this case, the folded table board assembly is convenient to lift and take through the first handle 101 and the second handle 102, so that it is convenient to carry.

Referring to FIG. 1, FIG. 2, FIG. 3 and FIG. 14, a lap fastener 103 is arranged on one side of the table board assembly; a catching groove 104 is formed in a side, away from the lap fastener 103, of the table board assembly; and the catching groove 104 corresponds to the lap fastener 103. A plurality of table board assemblies can be stably spliced through the lap fasteners 103 and the catching grooves 104, so that the usable area of the portable folding outdoor table is expanded, and the usage experience is excellent.

According to the portable folding outdoor table provided by the present disclosure, during storage, the first table board and the second table board are folded, and in this case, the folded table board assembly is convenient to lift and take through the first handle and the second handle, so that it is convenient to carry; the table board assembly and the supporting leg assembly are convenient to disassemble and assemble and convenient to use; and the table board assembly can be turned and folded when the portable folding outdoor table is stored, so that the portable folding outdoor table occupies a small space and is convenient to transport and carry. A plurality of table board assemblies can be stably spliced, so that the usable area of the portable folding outdoor table is expanded, and the usage experience is excellent; and by means of supporting forces of the first locating hinged board and the second locating hinged board, the structural stability of the first table board and the second table board in use is improved. The third torsional spring and the fourth torsional spring can assist to drive the first table board and the second table board to be folded together, so that it is more convenient and labor-saving to fold the first table board and the second table board. The four locking handles are respectively arranged at four corner positions of the bottom of the table board assembly. The supporting leg assembly supports the four corner positions of the table board assembly, so that the table board assembly is unlikely to topple, and the supporting effect is good. The supporting leg assembly can better support the table board assembly after being unfolded, occupies a small space after being folded and stored, and is convenient to transport and carry.

The above is merely the preferred implementations of the present disclosure. It shall be pointed out that those of ordinary skill in the art still can make several improvements and embellishments without departing from the technical principle of the present disclosure, and these improvements and embellishments shall also be regarded within the protection scope of the present disclosure.

What is claimed is:

1. A portable folding outdoor table, comprising a table board assembly, and a supporting leg assembly detachably connected to the table board assembly, wherein the table board assembly comprises a first table board (1), and a second table board (2) hinged with the first table board (1); a hinged locating mechanism is arranged between the first table board (1) and the second table board (2); the hinged locating mechanism comprises a first planar hinged board (3), a second planar hinged board (4), a first locating hinged board (5) and a second locating hinged board (6); the first planar hinged board (3) is fixedly connected to the first table board (1); the second planar hinged board (4) is fixedly connected to the second table board (2); the second planar hinged board (4) is hinged with the first planar hinged board (3); the first locating hinged board (5) is hinged to a side end of the first planar hinged board (3); the second locating hinged board (6) is hinged to a side end of the second planar hinged board (4); and the first locating hinged board (5) is hinged with the second locating hinged board (6).

2. The portable folding outdoor table according to claim 1, wherein a first torsional spring (71) and a first hinged shaft (81) are arranged between the first planar hinged board (3) and the first locating hinged board (5), the first planar hinged board (3) is hinged with the first locating hinged board (5) through the first hinged shaft (81), the first torsional spring (71) is sleeved on the first hinged shaft (81), and the first torsional spring (71) is used to drive the first locating hinged board (5) to turn toward one side of the first planar hinged board (3); and when the first locating hinged board (5) is turned to be perpendicular to the first planar hinged board (3), the first locating hinged board (5) abuts against the first planar hinged board (3) to be located.

3. The portable folding outdoor table according to claim 1, wherein a second torsional spring (72) and a second hinged shaft (82) are arranged between the second planar hinged board (4) and the second locating hinged board (6), the second planar hinged board (4) is hinged with the second locating hinged board (6) through the second hinged shaft (82), the second torsional spring (72) is sleeved on the second hinged shaft (82), and the second torsional spring (72) is used to drive the second locating hinged board (6) to turn toward one side of the second planar hinged board (4); and when the second locating hinged board (6) is turned to be perpendicular to the second planar hinged board (4), the second locating hinged board (6) abuts against the second planar hinged board (4) to be located.

4. The portable folding outdoor table according to claim 1, wherein a third torsional spring (73) and a third hinged shaft (83) are arranged between the first planar hinged board (3) and the second planar hinged board (4), the first planar hinged board (3) is hinged with the second planar hinged board (4) through the third hinged shaft (83), the third torsional spring (73) is sleeved on the third hinged shaft (83), and the third torsional spring (73) is used to drive the first planar hinged board (3) and the second planar hinged board (4) to turn and fold.

5. The portable folding outdoor table according to claim 1, wherein a fourth torsional spring (74) and a fourth hinged shaft (84) are arranged between the first locating hinged board (5) and the second locating hinged board (6), the first locating hinged board (5) is hinged with the second locating hinged board (6) through the fourth hinged shaft (84), the fourth torsional spring (74) is sleeved on the fourth hinged shaft (84), and the fourth torsional spring (74) is used to drive the first locating hinged board (5) and the second locating hinged board (6) to turn and fold.

6. The portable folding outdoor table according to claim 1, wherein a fast disassembling and assembling mechanism is arranged between the supporting leg assembly and the table board assembly; the fast disassembling and assembling mechanism comprises a plurality of locking handles (91) and snap fasteners (92) corresponding to the locking handles (91); the locking handles (91) are rotatably arranged on the table board assembly; the snap fasteners (92) are fixedly arranged on the supporting leg assembly; each of the locking handles (91) comprises a handle (911) and an arc-shaped clamping board (912); and a first clamping groove (921) corresponding to the clamping board (912) is formed in the snap fastener (92).

7. The portable folding outdoor table according to claim 6, wherein a clamping block (922) is arranged on the snap fastener (92), and a second clamping groove (923) corresponding to the clamping block (922) is formed in the table board assembly.

8. The portable folding outdoor table according to claim 6, wherein the table board assembly is in a shape of a cuboid; four locking handles (91) are arranged; a quantity of the snap fasteners (92) is identical to a quantity of the locking handles (91); the snap fastener (92) is arranged on an upper portion of the supporting leg assembly; and the four locking handles (91) are respectively arranged at four corner positions of a bottom of the table board assembly.

9. The portable folding outdoor table according to claim 1, wherein the supporting leg assembly comprises an upper support (10), a lower support (11), upper supporting legs (12) and lower supporting legs (13); the upper support (10) is arranged above the lower support (11); a plurality of upper supporting legs (12) are arranged; lower ends of the upper supporting legs (12) are hinged to the lower support (11); a plurality of lower supporting legs (13) are arranged; upper ends of the lower supporting legs (13) are hinged to the upper support (10); the upper supporting legs (12) and the lower supporting legs (13) are identical in quantity and correspond one by one; and the upper supporting legs (12) are hinged with the corresponding lower supporting legs (13).

10. The portable folding outdoor table according to claim 1, wherein a first handle (101) is arranged on a side, away from the second table board (2), of the first table board (1), and a second handle (102) is arranged on a side, away from the first table board (1), of the second table board (2).

11. The portable folding outdoor table according to claim 1, wherein a lap fastener (103) is arranged on one side of the table board assembly; a catching groove (104) is formed in a side, away from the lap fastener (103), of the table board assembly; and the catching groove (104) corresponds to the lap fastener (103).

* * * * *